US008955945B2

(12) United States Patent
Miwa et al.

(10) Patent No.: US 8,955,945 B2
(45) Date of Patent: Feb. 17, 2015

(54) IMAGE FORMING DEVICE

(71) Applicants: Atsushi Miwa, Tokyo (JP); Tomohiro Sawai, Kanagawa (JP); Isamu Kubo, Kanagawa (JP)

(72) Inventors: Atsushi Miwa, Tokyo (JP); Tomohiro Sawai, Kanagawa (JP); Isamu Kubo, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/044,957

(22) Filed: Oct. 3, 2013

(65) Prior Publication Data

US 2014/0098159 A1 Apr. 10, 2014

(30) Foreign Application Priority Data

Oct. 4, 2012 (JP) ..... 2012-222425

(51) Int. Cl.
*B41J 2/165* (2006.01)

(52) U.S. Cl.
CPC ..... *B41J 2/16505* (2013.01); *B41J 2/16523* (2013.01)
USPC ..... 347/30; 347/23; 347/35

(58) Field of Classification Search
CPC ..... B41J 23/02; B41J 23/025; B41J 23/04; B41J 23/12
USPC ..... 347/29–30, 84–85, 23, 35–37
See application file for complete search history.

(56) References Cited

U.S. PATENT DOCUMENTS

| | | | | |
|---|---|---|---|---|
| 6,761,438 | B2 | 7/2004 | Sato et al. | |
| 8,033,637 | B2 | 10/2011 | Kubo | |
| 8,038,271 | B2 | 10/2011 | Kubo et al. | |
| 8,177,313 | B2 | 5/2012 | Suzuki et al. | |
| 8,205,961 | B2 | 6/2012 | Kubo | |
| 8,454,122 | B2 | 6/2013 | Kubo | |
| 2012/0287202 | A1* | 11/2012 | Suzuki et al. | 347/30 |
| 2013/0057605 | A1 | 3/2013 | Miwa | |

FOREIGN PATENT DOCUMENTS

| | | |
|---|---|---|
| JP | 2005-144911 | 6/2005 |
| JP | 4019694 | 12/2007 |
| JP | 2013-136230 | 7/2013 |

* cited by examiner

*Primary Examiner* — Jason Uhlenhake
(74) *Attorney, Agent, or Firm* — Cooper & Dunham LLP

(57) ABSTRACT

An image forming device includes a drive transfer device that selectively transmits a driving force of a first drive source to one of liquid feed pumps, a suction part of a maintenance recovery device and an air-vent opening part. The air-vent opening part is arranged to have a maximum driving-force transmission path leading to the drive transfer device among the liquid feed pumps, the suction part and the air-vent opening part. The maintenance recovery device, the drive transfer device and the liquid feed pumps are arranged in order in a sheet transport direction. The suction part of the maintenance recovery device and the drive transfer device are arranged on opposite sides of a cap of the maintenance recovery device in the sheet transport direction.

12 Claims, 21 Drawing Sheets

IMAGE FORMING DEVICE

BACKGROUND OF THE INVENTION

1. Field of the Invention

The present invention relates to an image forming device including a recording head adapted to discharge liquid drops.

2. Description of the Related Art

Among image forming devices, including printers, facsimile machines, copiers, plotters, multi-function peripherals, etc., an ink-jet image forming device using a recording head which includes a plurality of liquid drop discharge heads (or liquid discharge heads) to discharge liquid drops is known.

For example, in the ink-jet image forming device of this type, a plurality of main tanks (ink cartridges) which respectively contain inks of different colors to be supplied to a recording head adapted to discharge ink drops of the colors may be provided, and a plurality of head tanks which respectively receive the inks of the colors supplied from the main tanks and supply the inks of the colors to the recording head may be provided.

Moreover, the ink-jet image forming device of this type may include a maintenance recovery device which maintains and recovers states of nozzle faces of the recording head and its performance. The maintenance recovery device usually includes a suction cap for capping the nozzle faces of the recording head and a suction pump connected with the suction cap.

Further, each of the head tanks in the ink-jet image forming device may include an air vent device which leads to the internal space of the head tank and is operable to make the tank internal space open to the atmosphere of the outside, and the air vent device may be opened by an air-vent opening part arranged on the housing of the image forming device.

If plural drive motors are arranged in an image forming device as drive sources for respectively driving plural driven components, such as liquid feed pumps, the suction pumps and the air-vent opening parts, the image forming device will be enlarged in size and the cost will be increased.

Regarding a drive mechanism for driving the liquid feed pumps, Japanese Patent No. 4,019,694 discloses an ink-jet image forming device which includes plural ink passages, plural ink-feed pumps arranged for transferring inks to a recording head via the ink passages, a single motor arranged for selectively driving the pumps, and a selecting/driving device arranged for selecting one of the pumps to be driven by a first-direction rotating power obtained from the motor and for driving the selected pump by a second-direction rotating power obtained from the motor. There is no disclosure in Japanese Patent No. 4,019,694 regarding a drive mechanism for driving the suction pumps, the maintenance recovery device, and the air-vent opening parts.

However, if an image forming device is provided with a drive transfer device which transfers a driving force of a single drive source selectively to one of the plural driven components described above, then the liquid feed pumps, the suction pumps, the maintenance recovery device, the air-vent opening parts, and the drive transfer device must be arranged in a limited space in the housing of the image forming device. Consequently, a problem arises that the size of the device housing must be enlarged to accommodate all of such components therein.

SUMMARY OF THE INVENTION

In one aspect, the present invention provides an image forming device including a recording head adapted to discharge liquid drops and a limited number of drive sources which can ensure downsizing of the image forming device.

In an embodiment which solves or reduces the above-mentioned problem, the present invention provides an image forming device including: a recording head adapted to discharge liquid drops of different kinds; a plurality of head tanks that supply liquids of the different kinds to the recording head; a plurality of main tanks that contain the liquids to be supplied to the recording head; a plurality of liquid feed pumps that supply the liquids from the plurality of main tanks to the plurality of head tanks and send back the liquids from the plurality head tanks to the plurality of main tanks; a maintenance recovery device that maintains and recovers states of nozzle faces of the recording head, the maintenance recovery device including a cap operable to perform capping of the nozzle faces of the recording head and a suction part connected to the cap; an air-vent opening part that is operable to open and close an air vent device disposed in each of the plurality of head tanks so as to make an internal space of each of the plurality of head tanks open to an external atmosphere; a first drive source; and a drive transfer device that selectively transmits a driving force of the first drive source to one of the plurality of liquid feed pumps, the suction part of the maintenance recovery device and the air-vent opening part, wherein the air-vent opening part is arranged to have a maximum driving-force transmission path leading to the drive transfer device among the plurality of liquid feed pumps, the suction part and the air-vent opening part, to which the driving force of the first drive source is transmitted by the drive transfer device, wherein the maintenance recovery device, the drive transfer device and the plurality of liquid feed pumps are arranged in order in a sheet transport direction, and wherein the suction part of the maintenance recovery device and the drive transfer device are arranged on opposite sides of the cap of the maintenance recovery device in the sheet transport direction.

Other objects, features and advantages of the present invention will be more apparent from the following detailed description when read in conjunction with the accompanying drawings.

DETAILED DESCRIPTION OF THE PREFERRED EMBODIMENTS

A description will be given of embodiments of the invention with reference to the accompanying drawings.

An embodiment of the image forming device according to the invention will be described with reference to FIGS. 1 to 4.

Figure 1:
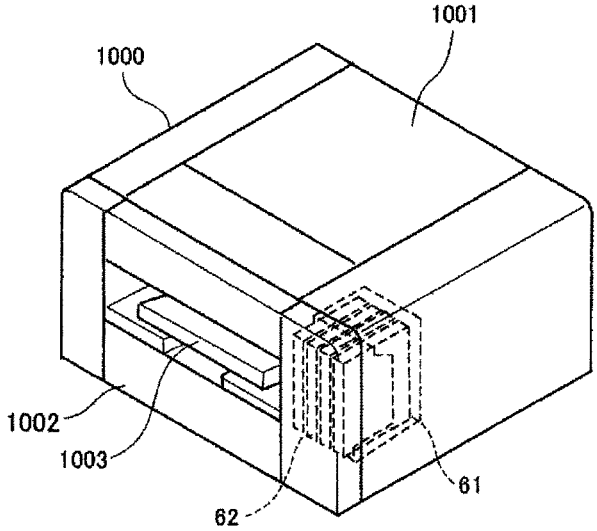
FIG. 1 is a perspective view showing an appearance of an image forming device according to an embodiment of the invention.
Figure 2:
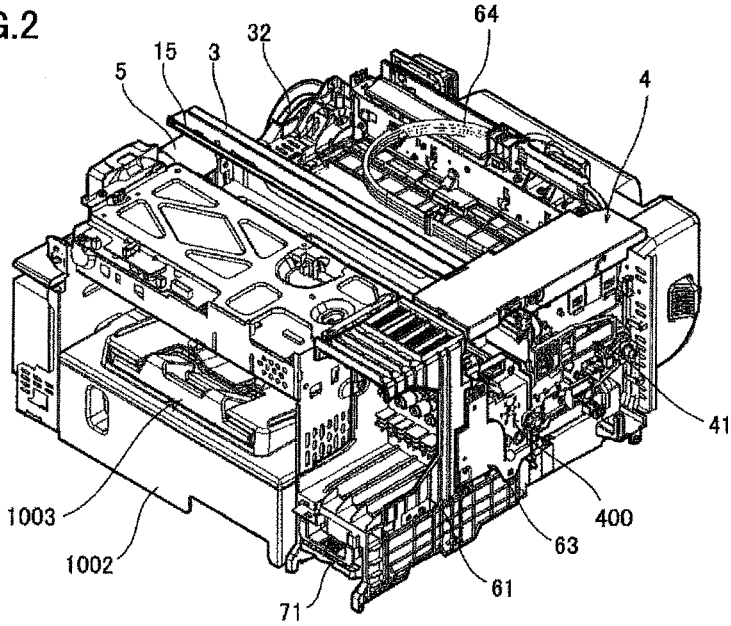
FIG. 2 is a perspective view of a mechanical part of the image forming device.
Figure 3:
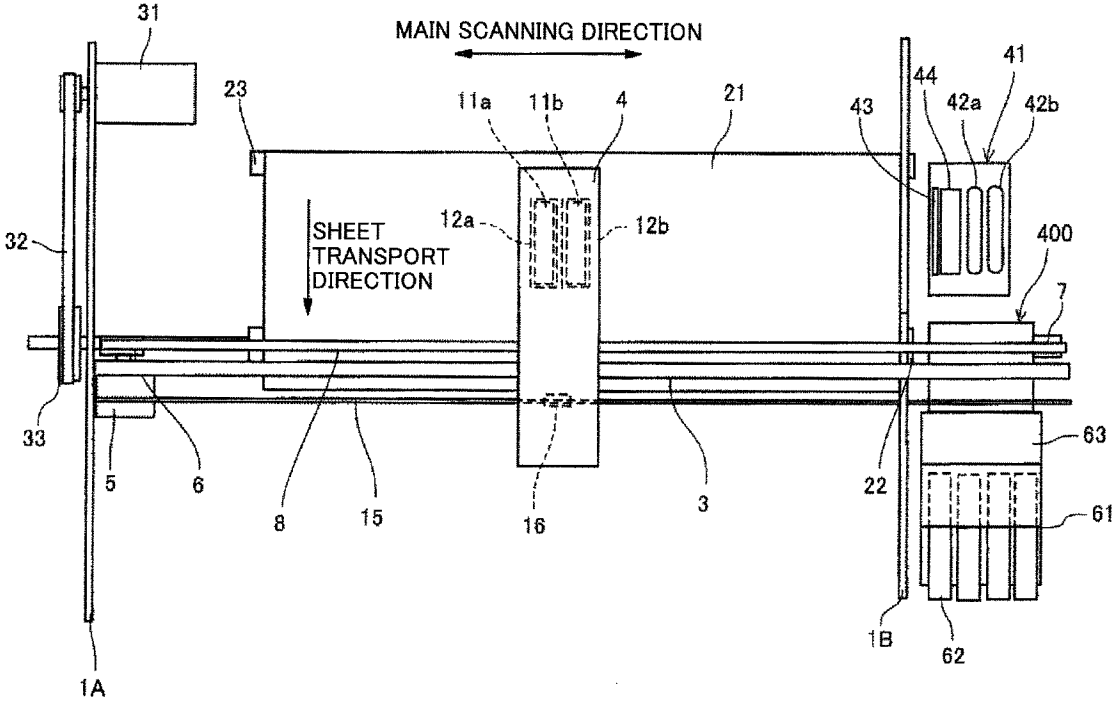
FIG. 3 is a plan view showing a main portion of the mechanical part of the image forming device.
Figure 4:
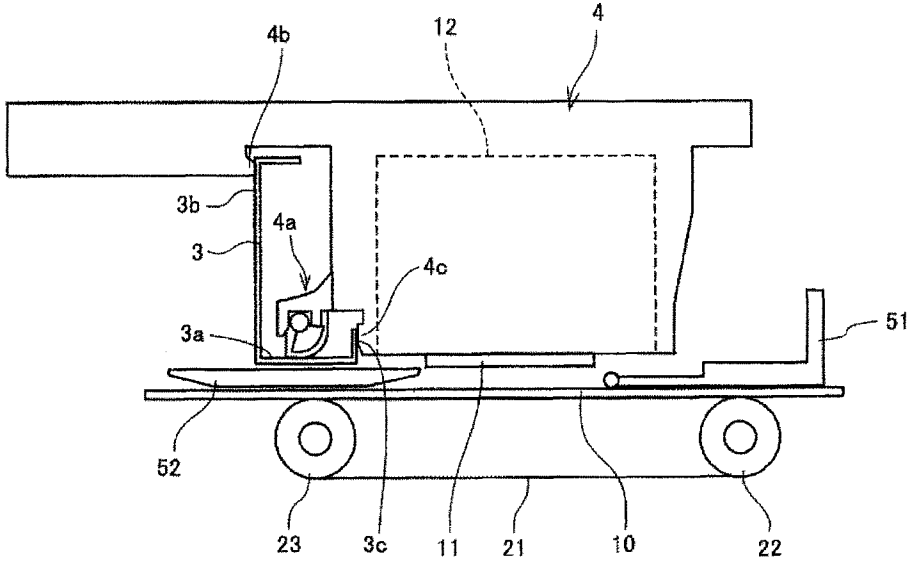
FIG. 4 is a side view showing a carriage portion of the mechanical part of the image forming device.

FIG. 1 is a perspective view showing an appearance of the image forming device according to the embodiment. FIG. 2 is a perspective view of a mechanical part of the image forming device. FIG. 3 is a plan view showing a main portion of the mechanical part of the image forming device. FIG. 4 is a side view showing a carriage portion of the mechanical part of the image forming device.

The image forming device of this embodiment is a serial type image forming device. A cover 1001 is arranged on a top surface of a housing 1000 so that the cover 1001 may be freely opened or closed. An internal mechanical part of the image forming device may be accessed when the cover 1001 is opened.

As shown in FIGS. 2 and 3, in the image forming device, a carriage 4 is held to be movable in a main scanning direction, indicated by the arrow in FIG. 3, by a guide member 3. This guide member 3 is formed from a plate-like member and arranged to transversely extend between a left-hand side plate 1A and a right-hand side plate 1B. The carriage 4 is moved in the main scanning direction through a circulating rotation of a timing belt 8 when a main-scan motor 5 is activated. The timing belt 8 is arranged under tension between a drive pulley 6 and an idler pulley 7.

As shown in FIG. 4, the guide member 3 for guiding the movement of the carriage 4 is formed from a plate-like member and includes a horizontal guide surface 3*a* and vertical guide surfaces 3*b* and 3*c*. The guide surfaces 3*a*-3*c* serve as support surfaces for guiding the movement of the carriage 4.

The carriage 4 includes a height adjustment part 4*a*, a contact part 4*b* and a contact part 4*c*. The height adjustment part 4*a* is held movably by the guide surface 3*a* of the guide member 3. The contact part 4*b* is in contact with the guide surface 3*b* of the guide member 3 to be movable in the main scanning direction. The contact part 4*c* is in contact with the guide surface 3*c* of the guide member 3 to be movable in the main scanning direction.

The carriage 4 carries recording heads 11*a* and 11*b* (which may be collectively referred to as recording head 11) which are attached to the carriage 4. The recording heads 11*a* and 11*b* form liquid discharge heads (image formation unit) adapted to discharge liquid drops of respective colors of yellow (Y), cyan (C), magenta (M) and black (K). In each of the recording heads 11*a* and 11*b*, two rows of nozzles are arrayed in a sub-scanning direction perpendicular to the main scanning direction. The nozzle faces of the recording heads 11*a* and 11*b* are directed to the downward vertical direction.

Each of the recording heads 11*a* and 11*b* includes two rows of nozzles on the nozzle face and each of the four nozzle rows is assigned to discharge liquid drops of a corresponding one of the four colors of Y, M, C and K, respectively.

Head tanks 12*a* and 12*b* (which may be collectively referred to as head tank 12) are integrally formed to the recording heads 11*a* and 11*b*, and the head tanks 12*a* and 12*b* supply ink to the recording heads 11*a* and 11*b*, respectively. On the other hand, on the housing of the image forming device, liquid cartridges (ink cartridges or main tanks) 62 are detachably attached to a cartridge holder 61 such that the liquid cartridges 62 are exchangeable with new liquid cartridges. The ink (liquid) from the ink cartridges 62 is supplied to the head tanks 12 via a supply tube 64 when a liquid feed pump unit 63 is activated.

An encoder scale 15 is arranged along a line in parallel with the main scanning direction of the carriage 4. An encoder sensor 16 is attached to the bottom surface of the carriage 4 and includes a transmission type photosensor to detect the reading of the encoder scale 15. The encoder scale 15 and the encoder sensors 16 constitute a linear encoder as a position detection device.

Under the carriage 4, a transport belt 21 as a sheet transport part is arranged to transport a recording sheet 10 in a sheet transport direction (sub-scanning direction). The transport belt 21 is formed from an endless belt, and this transport belt 21 is wound between a transport roller 22 and a tension roller 23. When a sub-scan motor 31 is activated, the transport roller 22 is rotated through a timing belt 32 and a timing belt pulley 33 by the sub-scan motor 31, and the transport belt 21 is moved in the sub-scanning direction by the rotation of the transport roller 22.

As shown in FIG. 4, a sheet guide member 51 and a sheet guide member 52 are arranged at a sheet inlet part and a sheet outlet part of the transport belt 21, respectively.

Moreover, as shown in FIGS. 2 and 3, a maintenance recovery device (maintenance unit) 41 is arranged at a side portion of the transport belt 21 on a right-hand side of the carriage 4 in the main scanning direction, and this maintenance recovery device 41 maintains and recovers the states of the nozzle faces of the recording head 11. For example, the maintenance recovery device 41 may include a suction cap 42*a*, a moisture cap 42*b*, a wiper member 43 and a dummy discharge receptacle 44. The suction cap 42*a* and the moisture cap 42*b* (which may be collectively referred to as cap 42) are operable to perform capping of the nozzle faces of the recording head 11. The wiper member 43 is operable to wipe away the nozzle faces of the recording head 11. The dummy discharge receptacle 44 is operable to receive dummy liquid drops that do not contribute to image formation but are discharged for the sake of head cleaning. A suction pump 46 (see FIG. 7) as a suction part is connected to the suction cap 42*a*.

Moreover, as shown in FIG. 1, in the image forming device, a sheet supply tray 1002 and a sheet ejection tray 1003 are detachably attached to the housing 1000. The sheet supply tray 1002 constitutes a sheet supplying part to supply a recording sheet to the transport belt 21, and the sheet ejection tray 1003 constitutes a sheet ejection part to which a recording sheet on which an image is formed with the liquid drops discharged by the recording head 11 as an image formation unit is ejected.

In the above-described image forming device, the recording sheet is intermittently transported by the transport belt 21 and the recording head 11 is driven in accordance with an image signal while the carriage 4 is moved in the main scanning direction. The recording head 11 is operated to discharge liquid drops to the recording sheet to record a line image. After the recording sheet is transported by a predetermined pitch, the recording head 11 is operated to record a next line image. This procedure is repeated, and an image is formed on the recording sheet. After the image formation is completed, and the recording sheet is ejected to the sheet ejection tray.

When the maintenance and recovery of the states of the nozzle faces of the recording head 11 is performed, the carriage 4 is moved to its home position where the carriage 4 faces the maintenance recovery device 41. The maintenance and recovery operation is performed on the recording head 11 by the maintenance recovery device 41 with the carriage 9 located at its home position. By using the suction cap 42*a*, the capping of the nozzle faces of the recording head 11 is performed and the suction of the remaining liquid from the nozzles is performed. By using the suction cap 42*a* or the dummy discharge receptacle 94, the dummy discharging of liquid drops that do not contribute to image formation is performed. By performing the maintenance and recovery operation, the image formation can be performed with stable liquid drop discharging.

Figure 5:
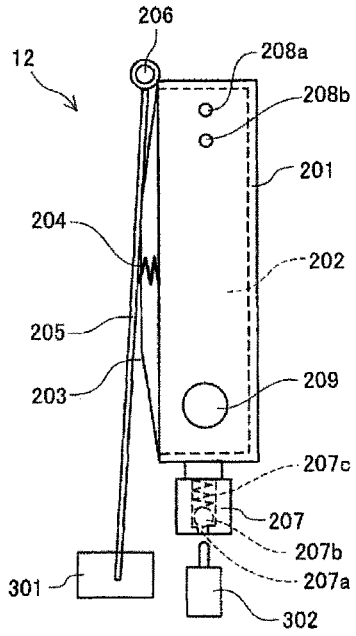
FIG. 5 is a plan view of an example of a head tank.

Next, an example of the head tank 12 will be described with reference to FIGS. 5 and 6. FIG. 5 is a plan view of the head tank 12, and FIG. 6 is a front view of the head tank 12 of FIG. 5.

Figure 6:
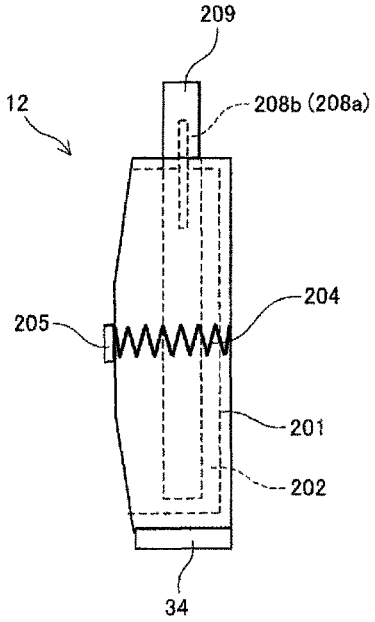
FIG. 6 is a front view of the head tank of FIG. 5.

As shown in FIGS. 5 and 6, the head tank 12 includes a tank case 201 which forms an ink accommodating portion 202 for holding ink therein. One of side faces of the tank case 201 is formed into an opening, and this opening of the tank case 201 is hermetically sealed by a flexible film-like member 203. The film-like member 203 is pressed outward by a spring 204 (an elastic member) arranged in the tank case 201. The outward pressing force is exerted on the back surface of the film-like member 203 by the spring 204, and as the amount of the remaining ink in the tank case 201 decreases, a negative pressure will be produced in the tank case 201.

A detection filler 205 is provided outside the tank case 201 and bonded to the film-like member 203 by adhesive. This detection filler 205 is initially pulled towards the inside of the tank case 201 and serves as a displacement member. One end of the detection filler 205 is rotatably supported by a pivot 206 fixed to the tank case 201.

In accordance with the movement of the film-like member 203, the other end of the detection filler 205 is moved together around the pivot 206. Hence, the amount of the remaining ink in the head tank 12 can be detected by measuring an amount of displacement of the detection filler 205 from its original position around the pivot 206 using a detection sensor 301. The detection sensor 301 is formed from a photosensor and disposed on the housing of the image forming device.

Figure 7:
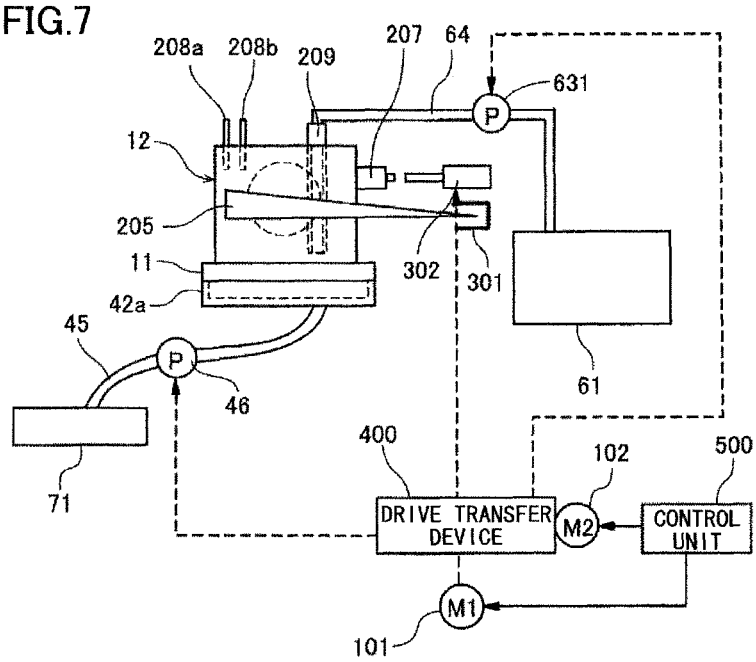
FIG. 7 is a diagram showing an ink supply/drain system in the image forming device.

An inlet port 209 for receiving ink from the ink cartridge 62 and sending the ink to the inside of the head tank 12 is formed on the upper surface of the tank case 201, and this inlet port 209 is connected to the supply tube 64 (see FIG. 7). An air vent device 207 is disposed on a side part of the tank case 201, and the air vent device 207 is operable to make the internal space of the head tank 12 open to an external atmosphere.

As shown in FIG. 5, the air vent device 207 includes an air vent 207*a*, a valve body 207*b* and a spring 207*c*. The air vent 207*a* is formed to lead to the inside of the head tank 12, and the valve body 207*b* is internally disposed to be operable to open and close the air vent 207*a*. The spring 207*c* is disposed to push the valve body 207*b* toward the air vent 207*a* so as to place the air vent device 207 in a closed state.

When the valve body 207*b* is pushed back against the spring 207*c* by an air-vent opening pin 302 (see also FIG. 7), the air vent device 207 is set in an open state and the air vent 207*a* of the head tank 12 is opened to the external atmosphere. The air-vent opening pin 302 is an air-vent opening part disposed on the image formed device (see FIG. 16).

Moreover, as shown in FIGS. 5 and 6, electrode pins 208*a* and 208*b* are disposed in the head tank 12 to detect the amount of the remaining liquid (ink) in the head tank 12. The ink in the head tank 12 is electrically conductive. When the level of the remaining ink in the head tank 12 is above the height of the lower ends of the electrode pins 208*a* and 208*b*, current flows between the electrode pins 208*a* and 208*b*. On the other hand, when the level of the remaining ink in the head tank 12 is below the height of the lower ends of the electrode pins 208*a* and 208*b*, the resistances of the electrode pins 208*a* and 208*b* are changed. By measuring a change of the current flowing through the electrode pins 208*a* and 208*b*, it is possible to detect that the ink level of the head tank 12 is below a predetermined height, or it is possible to detect that the amount of the remaining liquid in the head tank 12 is less than a predetermined amount.

Next, an ink supply/drain system in the image forming device will be described with reference to FIG. 7. FIG. 7 shows the ink supply/drain system in the image forming device. For the sake of convenience of illustration, an ink supply system from the ink cartridge to the head tank with respect to only one color of the plural colors is illustrated in the example of the ink supply/drain system in FIG. 7. Practically, however, the ink supply systems with respect to all of the plural colors are provided in the image forming device.

In the example of FIG. 7, ink from the ink cartridge (main tank) 62 is supplied to the head tank 12 via the supply tube 64 by a liquid feed pump 631 which forms one of the liquid feed parts provided for the respective colors in the liquid feed pump unit 63. The liquid feed pump 631 is a reversible pump which is formed from a tube pump or the like. The liquid feed pump 631 is operable to perform a liquid supply operation to supply the ink from the ink cartridge 62 to the head tank 12, and a reversal liquid-feed operation to return the ink from the head tank 12 back to the ink cartridge 62.

The suction cap 42*a* in the maintenance recovery device 41 is operable to perform capping of the nozzle faces of the recording head 11, and the suction pump 46 is connected to the suction cap 42*a*. When the suction pump 46 is driven while the capping of the nozzle faces of the recording head 11 is performed by the suction cap 42*a*, the ink is attracted from the nozzles of the head tank 12 through the suction tube 45.

The image forming device includes a first drain liquid tank 71 detachably attached to the housing 1000 and a second drain liquid tank fixed to the housing 1000. The drain ink from the suction pump 46 is sent to the first drain liquid tank 71. The drain ink from the dummy discharge receptacle 44 is sent to the second drain liquid tank.

The air-vent opening pin 302 is arranged on the housing of the image forming device, and this air-vent opening pin 302 is an air-vent opening part (pressing member) which opens and closes the air vent device 207 of the head tank 12. By operating the air-vent opening pin 302, the air vent device 207 can be opened. Further, the detection sensor 301 is arranged on the housing of the image forming device, and the detection sensor 301 contains the photosensor to detect the amount of the displacement of the detection filler 205 in the head tank 12.

In the image forming device of the present embodiment, a driving force of a first drive motor 101 (first drive source) is selectively transferred to one of the liquid feed pumps 631 of the plural colors, the suction pump 46 of the maintenance recovery device 41 and the air-vent opening pins 302 by a drive transfer device 400. Specifically, a drive switching operation is performed on the drive transfer device 400 by a second drive motor 102 (second drive source) to selectively engage an output drive shaft of the drive transfer device 400 with one of the liquid feed pumps 631, the suction pump 46 and the air-vent opening pins 302 as indicated by dotted lines in FIG. 7. In addition, a driving control operation to control the operation of each of the first drive motor 101 and the second drive motor 102 is performed by a control unit 500.

Figure 8:
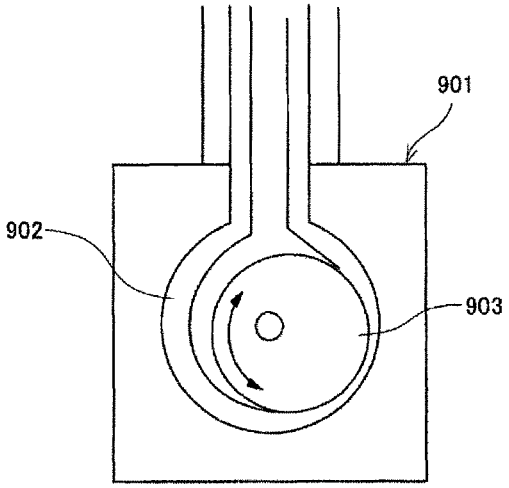
FIG. 8 is a diagram showing a tube pump used as a liquid feed pump in the image forming device.

Next, an example of a tube pump used as the liquid feed pump 631 will be described with reference to FIG. 8. FIG. 8 is a diagram showing a tube pump 901 used as the liquid feed pump 631 in the image forming device.

As shown in FIG. 8, the tube pump 901 is arranged to feed the liquid in a tube 902 when a pressure roller 903 is rotated around an off-center shaft in one of the directions indicated by the arrows in FIG. 8 to elastically deform the internal wall of the tube 902.

When the tube pump 901 is used as the liquid feed pump 631, the pressure roller 903 is rotated forward in one of the directions indicated by the arrows in FIG. 8 to supply the ink from the ink cartridge 62 to the head tank 12, and the pressure roller 903 is rotated backward in the other of the directions to return the ink from the head tank 12 back to the ink cartridge 62.

Figure 9:
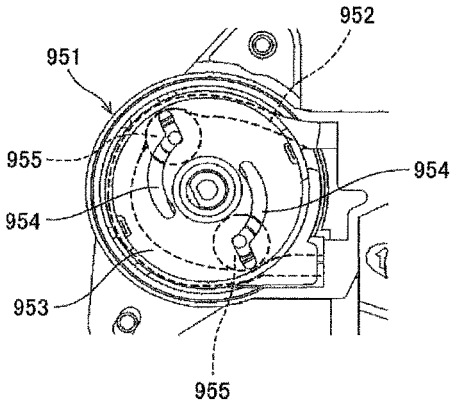
FIG. 9 is a diagram showing a tube pump used as a suction pump in the image forming device when the tube pump is rotated backward.

Next, an example of a tube pump used as the suction pump 46 in the image forming device will be described with reference to FIGS. 9 and 10. FIG. 9 is a diagram showing a tube pump 951 used as the suction pump 46 when the tube pump 951 is rotated backward, and FIG. 10 is a diagram showing the tube pump 951 used as the suction pump 46 when the tube pump 951 is rotated forward.

Figure 10:
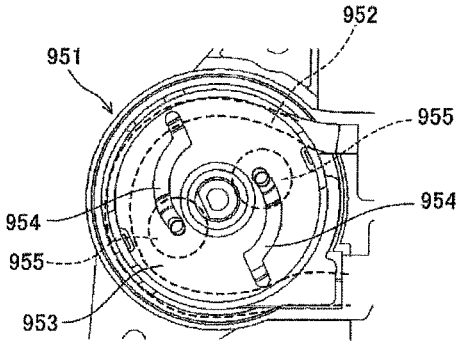
FIG. 10 is a diagram showing the tube pump used as the suction pump in the image forming device when the tube pump is rotated forward.

As shown in FIGS. 9 and 10, the tube pump 951 includes a tube 952, a rotating member 953 on the inner peripheral surface of the tube 952, and rollers 955 movably supported on guide grooves 954 formed in the rotating member 953. The rollers 955 are movable along the guide grooves respectively. When the rotating member 953 is rotated backward (the backward rotating direction) as shown in FIG. 9, the rollers 955 are moved to the outer peripheral wall of the rotating member 953 and the tube 952 is elastically deformed by the rollers 955. On the other hand, when the rotating member 953 is rotated forward (the forward rotating direction) as shown in FIG. 10, the rollers 956 are moved to the inside of the rotating member 953 and separated from the tube 952 and the tube 952 is set in a non-deformed state.

Figure 11:
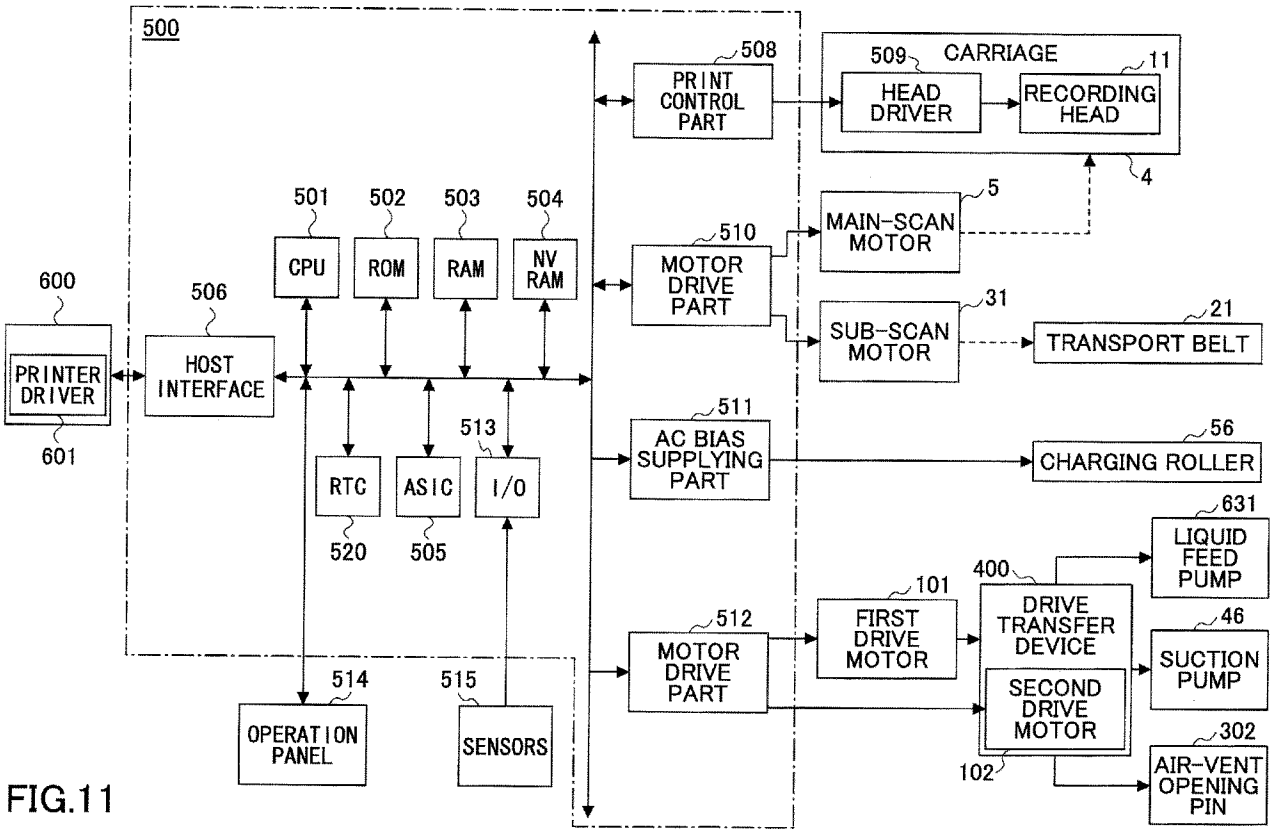
FIG. 11 is a block diagram showing the composition of a control unit in the image forming device.

Next, the composition of a control unit in the image forming device will be described with reference to FIG. 11. FIG. 11 is a block diagram showing the composition of a control unit 500 in the image forming device.

As shown in FIG. 11, this control unit 500 includes a CPU (central processing unit) 501, a ROM (read-only memory) 502, a RAM (random access memory) 503, a NVRAM (non-volatile RAM) 504, and an ASIC (application-specific IC) 505. The CPU 501 controls the whole image forming device including the first and second drive motors 101 and 102 and the drive transfer device 400. The ROM 502 is a memory which stores a program executed by the CPU 501 and other fixed data. The RAM 503 is a memory which temporarily stores image data. The NVRAM 504 is a rewritable memory which retains data even after the power of the image forming device is turned off. The ASIC 505 performs signal processing, image processing and sorting processing on image data, and signal processing on input/output signals to control the image forming device.

The control unit 500 further includes a host interface (I/F) 506, a print control part 508, a motor drive part 510, an AC bias supply part 511, a motor drive part 512 and an input/output (I/O) part 513. The print control part 508 includes a data transfer part and a drive signal generating part for performing the drive control of the recording head 11. The print control part 508 controls a head driver (driver IC) 509 provided in the carriage 4 for driving the recording head 11 on the carriage 4. The motor drive part 510 controls both the main-scan motor 5 which drives the movement of the carriage 4 and the sub-scan motor 31 which drives the rotation of the transport belt 21. The AC bias supplying part 511 supplies an AC bias to a charging roller 56. The motor drive part 512 controls both driving of the first drive motor 101 and driving of the second drive motor 102 provided in the drive transfer device 400.

An operation panel 514 is connected to the control unit 500 for enabling a user to input the desired information to the image forming device and for displaying the information related to the image forming device.

The host interface 506 provides the interface for performing transmission and reception of signals and data between a host device 600 and the image forming device. The host device 600 may be any of an image reading device, such as an image scanner, an information processing device, such as a personal computer, and an imaging device, such as a digital camera. By using the host interface 506, the CPU 501 of the control unit 500 in the image forming device receives signals and data from the host device 600 via a cable or a network.

The CPU 501 of the control unit 500 reads and analyzes the print data in the receiving buffer in the host interface 506, performs the required image processing and sorting processing on the image data by using the ASIC 505, and transmits the processed image data from the print control part 508 to the head driver 509. Creation of dot pattern data for performing image output processing may be performed by a printer driver 601 of the host device 600.

The print control part 508 transmits the processed image data to the head driver 509 as serial data, and transmits clock signals and control and latch signals for transmission of such image data to the head driver 509. Furthermore, the print control part 508 includes a D/A converter and a drive signal generating part. The D/A converter performs digital-to-analog (D/A) conversion of pattern data of a driving pulse stored in the ROM 502. The drive signal generating part includes a current amplifier and a voltage amplifier and outputs a driving signal containing one or more driving pulses to the head driver 509.

The head driver 509 drives the recording head 11 by selecting one of driving pulses which form a driving signal obtained from the print control part 508 based on the image data equivalent to one line of the image data serially input to the recording head 11 and supplying the selected driving pulse to the drive element (piezoelectric device) of the recording head 11 which generates the energy to discharge liquid drops. At this time, one of large dots, middle dots and small dots, which differ in dot size, can be selectively printed on a recording sheet by selecting one of the driving pulses which form the driving signal.

The input/output part 513 is operable to obtain detection information from various sensors 515 provided in the image forming device. The CPU 501 extracts information needed for the print control from the detection information obtained by the input/output part 513 and uses the extracted information to control each of the print control part 508, the motor drive part 510, and the AC bias supplying part 511.

The sensors 515 may include a photosensor for detecting a position of a recording sheet, a thermistor for monitoring a temperature and humidity inside the image forming device, a sensor for monitoring a voltage of a charging belt, and an interlock switch for detecting opening and closing of the cover 1001. The input/output part 513 is operable to process various items of detection information from the sensors 515. Moreover, the sensors 515 may include the detection sensor 301 for detecting the detection filler 205 of the head tank 12, and the electrode pins 208*a* and 208*b*, and the detection signals output from these sensors are also input to the input/output part 513.

Furthermore, the control unit 500 includes a real-time clock (RTC) part 520 which is used to measure an elapsed time.

Figure 12:
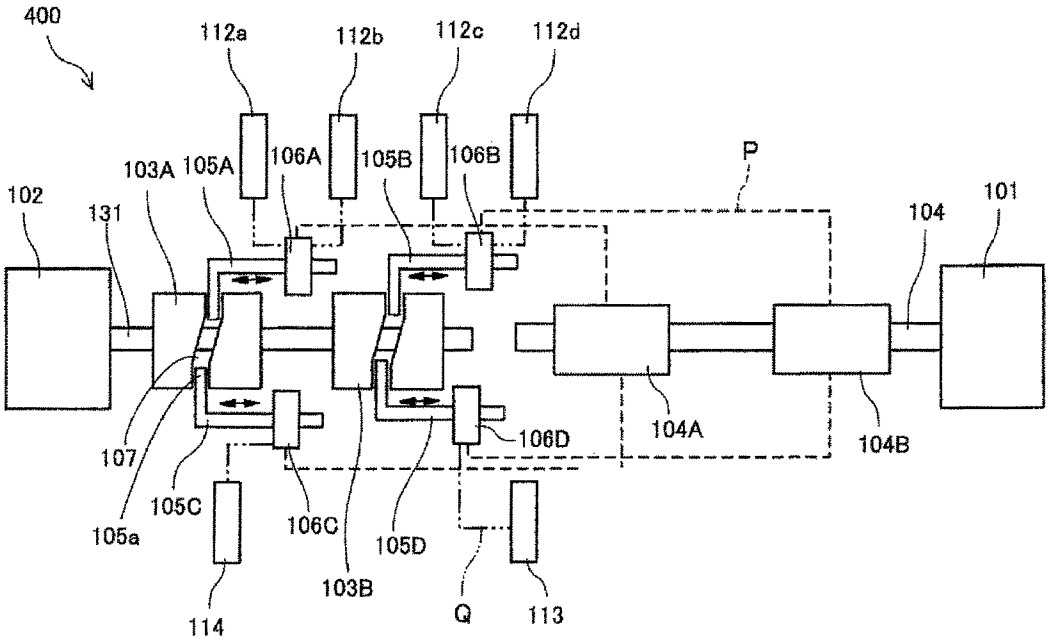
FIG. 12 is a diagram showing an example of a drive transfer device.
Figure 13:
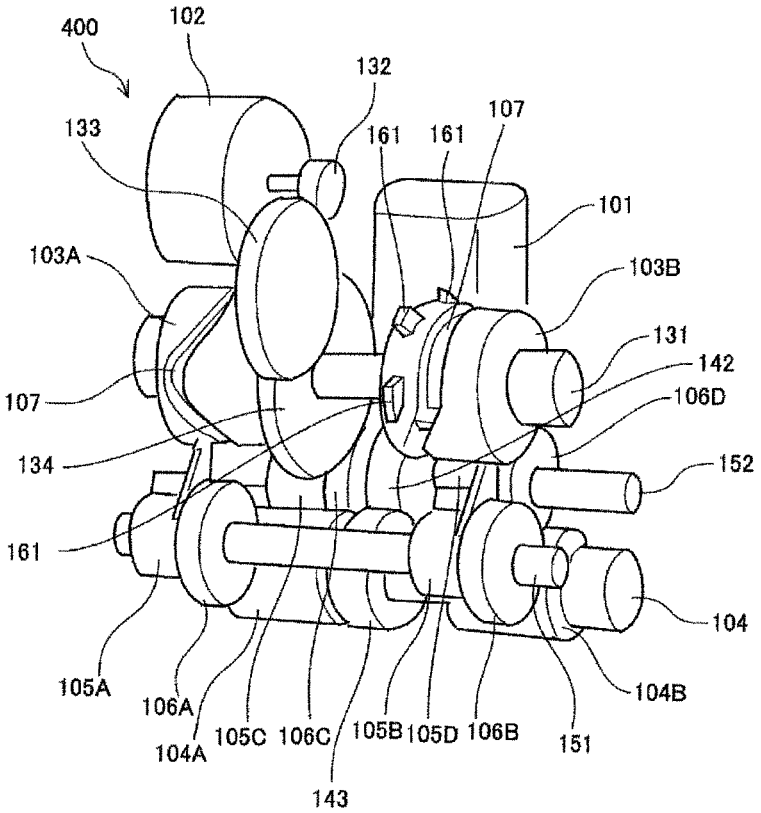
FIG. 13 is a perspective view of the drive transfer device.
Figure 14:
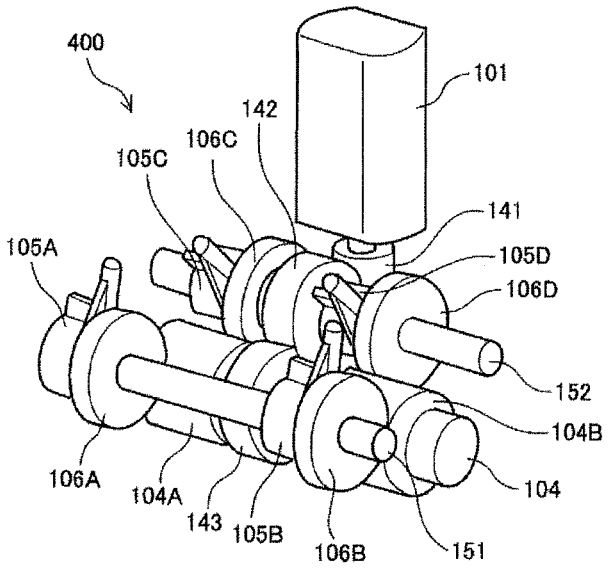
FIG. 14 is a perspective view of the drive transfer device from which a cam portion thereof is removed.
Figure 15:
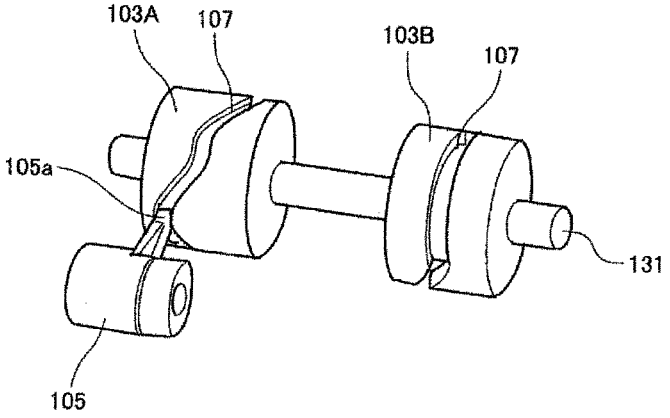
FIG. 15 is a perspective view of a cam and a slider member.

Next, an example of the drive transfer device 400 will be described with reference to FIGS. 12 to 15. FIG. 12 is a diagram showing an example of the drive transfer device 400. FIG. 13 is a perspective view of the drive transfer device 400. FIG. 14 is a perspective view of the drive transfer device 400 from which a cam portion thereof is removed. FIG. 15 is a perspective view of a cam and a slider member. In FIG. 12, a dotted line P linking the two blocks denotes that two gears corresponding to the blocks are always engaged with each other, and a phantom line Q linking the two blocks denotes that two gears corresponding to the blocks have an engagement or disengagement relation.

As shown in FIGS. 12 and 13, gears 104A and 104B are disposed on a driving shaft 104 which is rotated by the first drive motor 101. The second drive motor 102 in the drive transfer device 400 is formed from a stepping motor. Cams 103A and 103B (which may be collectively called cam 103) are disposed on a cam shaft 131 which is rotated by the second drive motor 102. In each of the cams 103A and 103B, a cam groove 107 is formed in an intermediate portion of the cam.

Engagement parts 105*a* are engaged with the cam grooves 107 of the cams 103A and 103B. The engagement parts 105*a* include slider members 105A-105D (which may be collectively called slider member 105) which are moved together in accordance with the rotation of the cams 103A and 103B in a thrust direction (which is parallel with the axial direction of the cam shaft 131) as indicated by the arrows in FIG. 12.

In FIG. 12, for the sake of convenience of illustration, the engagement part 105*a* of the slider member 105 and the cam groove 107 of the cam 103 are illustrated as if they were separated from each other. However, the engagement part 105*a* and the cam groove 107 are practically in contact with each other as described above.

A change gear 106A is rotatably supported on the slider member 105A, and the change gear 106A is engaged with the gear 104A which is rotated by the first drive motor 101. A change gear 106B is rotatably supported on the slider member 105B, and the change gear 106B is engaged with the gear 104B which is rotated by the first drive motor 101.

A change gear 106C is rotatably supported on the slider member 105C, and the change gear 106C is engaged with the gear 104A which is rotated by the first drive motor 101. A change gear 106D is rotatably supported on the slider member 105D, and the change gear 106D is engaged with the gear 104B which is rotated by the first drive motor 101.

For example, in accordance with the movement of the slider member 105A, the change gear 106A may be shifted between an engagement position where the change gear 106A is engaged with the drive gear 112*a* of the liquid feed pump 631 of the first color or the drive gear 112*b* of the liquid feed pump 631 of the second color and a disengagement position where the change gear 106A is disengaged from these drive gears.

For example, in accordance with the movement of the slider member 105B, the change gear 106B may be shifted between an engagement position where the change gear 106B is engaged with the drive gear 112*c* of the liquid feed pump 631 of the third color or the drive gear 112*d* of the liquid feed pump 631 of the fourth color and a disengagement position where the change gear 106B is disengaged from these drive gears.

For example, in accordance with the movement of the slider member 105D, the change gear 106D may be shifted between an engagement position where the change gear 106D is engaged with a drive gear 113 of the suction pump 46 of the maintenance recovery device 41 and a disengagement position where the change gear 106D is disengaged from the drive gear 113.

For example, in accordance with the movement of the slider member 105C, the change gear 106C may be shifted between an engagement position where the change gear 106C is engaged with a drive gear 114 (see FIG. 17) to move the air-vent opening pin 302 forward or backward and a disengagement position where the change gear 106C is disengaged from the drive gear 114.

In the present embodiment, the change gears 106A and 106B constitute a first change gear, the change gear 106C constitutes a second change gear, and the change gear 106D constitutes a third change gear. For example, the first to the fourth colors of the inks supplied from the four liquid feed pumps 631 correspond to any of black, cyan, magenta and yellow described above.

Specifically, in the composition shown in FIGS. 13 to 15, the driving force of the first drive motor 101 is transmitted to the driving shaft 104 through a motor gear 141, a gear 142 rotatably supported on a supporting shaft 152 and a gear 143 fixed to the driving shaft 104.

The driving force of the second drive motor 102 is transmitted to the cam shaft 131 through a motor gear 132, a gear 133 and a gear 134 fixed to the cam shaft 131. The slider member 105A, the change gear 106A, the slider member 105B and the change gear 106B are movably supported on a supporting shaft 151. The slider member 105C, the change gear 106C, the slider member 1050 and the change gear 106D are movably supported on the supporting shaft 152.

As shown in FIG. 13, plural projections 161 for detecting a rotational position of the cam shaft 131 are formed on the outer periphery of the cam 103B, and one of the projections 161 is detected by a sensor (which is not illustrated) so that a rotational position of the cam shaft 131 is detected.

Accordingly, when the first drive motor 101 is driven, the driving force of the first drive motor 101 is transmitted through the gears 104A and 104B to the first change gears 106A and 106B, the second change gear 106C and the third change gear 106D, so that the change gears 106A-106D are rotated.

When the second drive motor 102 is driven, the cams 103A and 103B are rotated, so that the slider members 105A-105D are moved in the direction indicated by the arrows in FIG. 12, and the first change gears 106A and 106B, the second change gear 106C and the third change gear 106D are moved together in the direction indicated by the arrows in FIG. 12.

At this time, when the first change gear 106A is shifted to the engagement position where the first change gear 106A is engaged with the drive gear 112*a*, the liquid feed pump 631 of the first color is driven. Similarly, when the first change gear 106A is shifted to the engagement position where the first change gear 106A is engaged with the drive gear 112*b*, the liquid feed pump 631 of the second color is driven.

Moreover, when the slider member 105B is moved in the direction indicated by the arrows in FIG. 12 and the first change gear 106B is shifted to the engagement position where the first change gear 106B is engaged with the drive gear 112*c*, the liquid feed pump 631 of the third color is driven. Similarly, when the first change gear 106B is shifted to the engagement position which the first change gear 106B is engaged with the drive gear 112*d*, the liquid feed pump 631 of the fourth color is driven.

Further, when the slider member 105D is moved in the direction indicated by the arrows in FIG. 12 and the third change gear 106D is shifted to the engagement position where the third change gear 106D is engaged with the drive gear 113, the suction pump 46 of the maintenance recovery device 41 is driven.

Further, when the slider member 105C is moved in the direction indicated by the arrows in FIG. 12 and the second change gear 106C is shifted to the engagement position where the second change gear 106C is engaged with the drive gear 114, the air-vent opening pin 302 is moved forward or backward.

In this case, even when the first drive motor 101 is rotated in any direction, the driving force of the first drive motor 101 may be transmitted to the liquid feed pump 631. Hence, the liquid feed pump 631 may be driven in any of the forward liquid supply direction (normal rotation direction) and the backward liquid supply direction (reverse rotation direction).

In the present embodiment, modification of the phases of the cam grooves 107 of the cams 103A and 103B or connection of the plural slider members 105 to the cams 103A and 103B at different phases may allow the change gears 106A-106D to be sequentially shifted during the rotation of the cams 103A and 103B, or may allow the change gears 106A-106D to be simultaneously connected to the plural drive gears.

By using the plurality of cams (in this example, two cams), the amount of movement of the change gears caused by each cam may be reduced and downsizing of each cam can be ensured. Even when five or more change gears are arranged in the thrust direction (the axial direction), it is not necessary to change the dimensions of the components in a direction other than the thrust direction.

Accordingly, the image forming device of the present embodiment includes the first drive source 101 that drives the liquid feed pumps 631, and the drive transfer device 400 that selectively transmits the driving force of the first drive source 101 to the liquid feed pumps 631, and the drive transfer device 400 includes the second drive source 102, the cam 103 that is rotated by the second drive source 102, the slider member 105 that is moved in the thrust direction in accordance with the rotation of the cam 103, and the first change gear 106A or 106B that is shifted between the engagement position where the first change gear is engaged with one of the drive gears 112 of the liquid feed pumps 631 and the disengagement position where the first change gear is disengaged from the drive gear by the movement of the slider member. In the image forming device of the present embodiment, the drive transfer device 400 selectively transmits the driving force of the first drive source 101 to the liquid feed pumps 631 by the shifting of the first change gear.

In the image forming device of the present embodiment, the first drive source of the liquid feed pumps 631 and the second drive source of the drive transfer device 400 are separated, and the plural pumps can be driven in a desired manner by using a limited number of drive sources. By using the drive transfer device in the present embodiment, it is possible to transmit the forward or backward rotation of the first drive source to the plural pumps independently of the drive gears of other pumps or components without being affected by the restrictions of other pumps or components.

Next, the arrangement of the drive transfer device, the liquid feed pumps, the maintenance recovery devices and the air-vent opening devices in the image forming device of the present embodiment will be described with reference to FIGS. 16 to 19.

Figure 16:
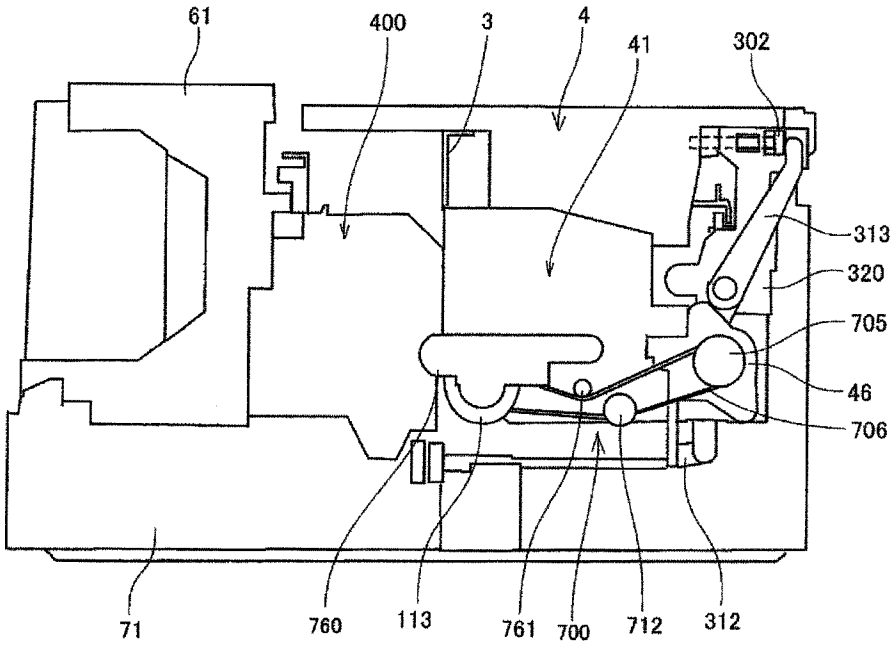
FIG. 16 is a side view of a mechanical part of the image forming device.
Figure 17:
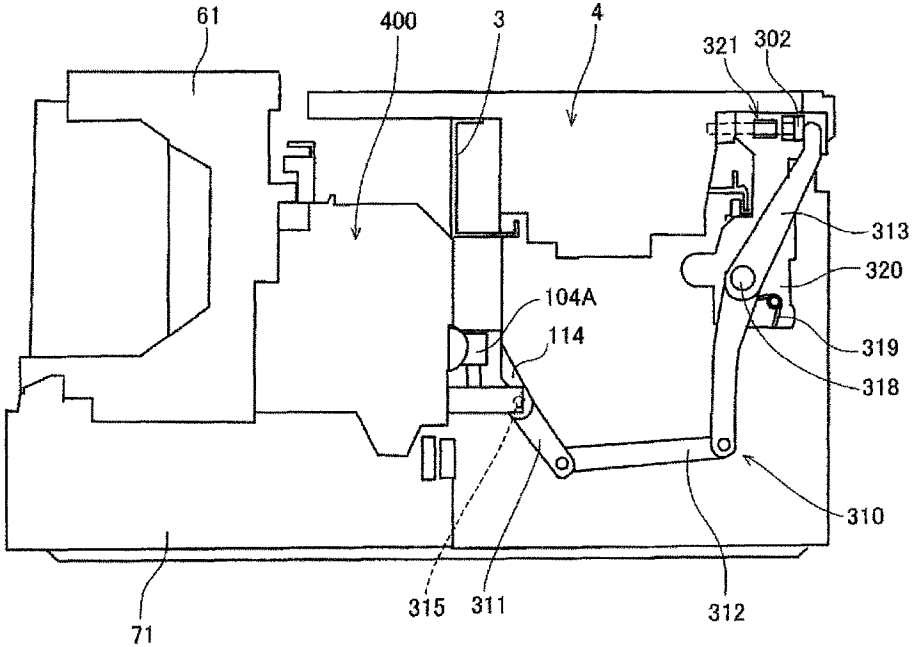
FIG. 17 is a side view of the mechanical part of the image forming device from which a maintenance recovery device is removed.
Figure 18:
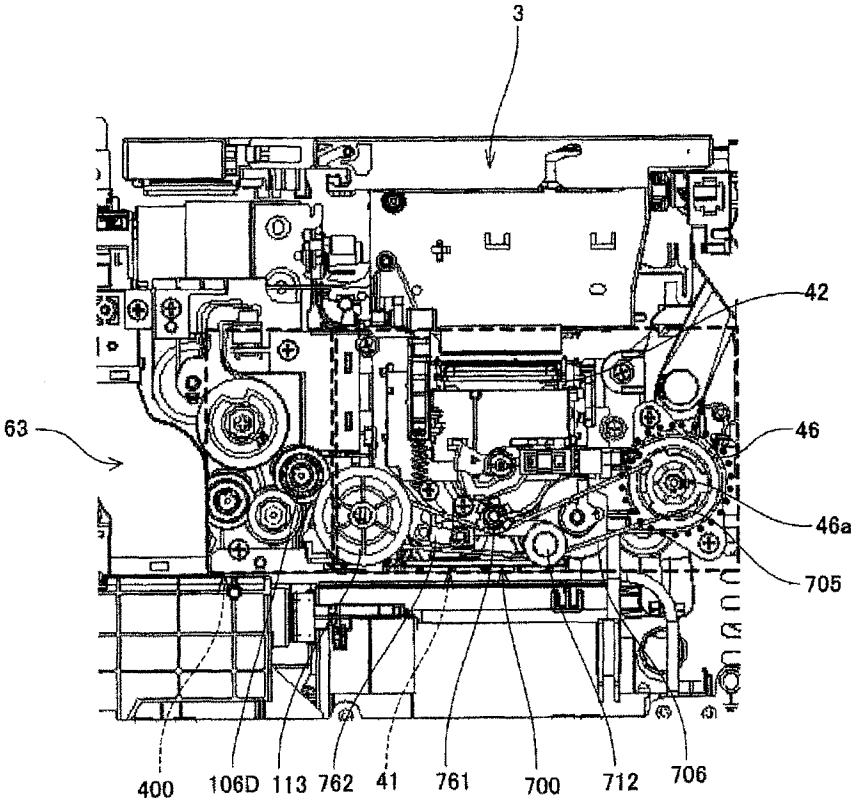
FIG. 18 is a side view of the mechanical part of the image forming device from which a cover of the drive transfer device and a cover of the maintenance recovery device are removed.
Figure 19:
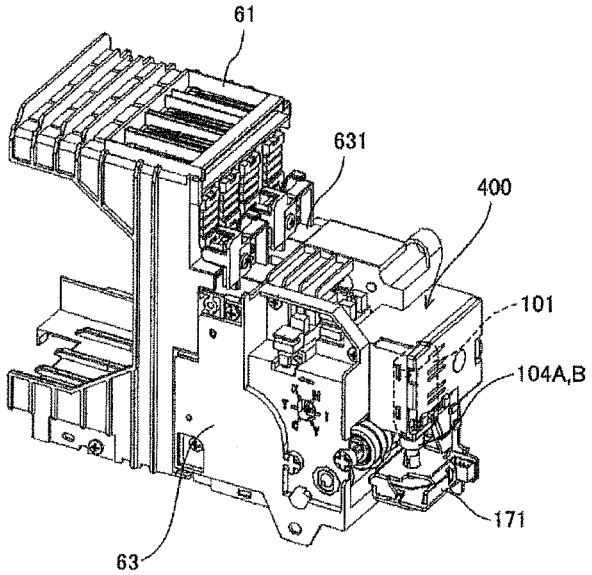
FIG. 19 is a perspective view of a cartridge holder, a liquid feed pump unit and the drive transfer device.

FIG. 16 is a side view of a mechanical part of the image forming device of the present embodiment. FIG. 17 is a side view of the mechanical part of the image forming device from which the maintenance recovery device 41 is removed. FIG. 18 is a side view of the mechanical part of the image forming device from which a cover of the drive transfer device 400 and a cover of the maintenance recovery device 41 are removed. FIG. 19 is a perspective view of the cartridge holder 61, the liquid feed pump unit 63 and the drive transfer device 400.

As shown in FIGS. 16 to 19, in the image forming device of this embodiment, the carriage 4 on which the recording head 11 and the head tank 12 are mounted, the cartridge holder 61 on which the ink cartridge 62 is mounted, the liquid feed pump unit 63 and the maintenance recovery device 41 are arranged.

In the image forming device of this embodiment, the cartridge holder 61, the liquid feed pump unit 63, the carriage 4 and the maintenance recovery device 41 are arranged in the sheet transport direction in this order. With respect to the height direction of the housing, the carriage 4 is arranged in a position higher than the positions of the liquid feed pump unit 63 and the maintenance recovery device 41.

With respect to the sheet transport direction, the drive transfer device 400 is arranged between the liquid feed pump unit 63 and the maintenance recovery device 41. With respect to the height direction of the housing, the drive transfer device 400 is arranged in a position lower than the position of the carriage 4.

As shown in FIGS. 16 to 19, the drive transfer device 400 is arranged in a position where it is surrounded by the liquid feed pump unit 63, the maintenance recovery device 41 and the carriage 4. The arrangement of the drive transfer device 400 is an optimum arrangement for ensuring downsizing of the image forming device.

In the image forming device of the present embodiment, the drive transfer device 400, the cartridge holder 61 and the liquid feed pump unit 63 are formed into a sub-unit, and the driving force of the drive gears 112*a*-112*d* of the drive transfer device 400 is transmitted to the liquid feed pump 631 of liquid feed pump unit 63 within the sub-unit.

The first drive motor 101 is arranged on the rear side of the drive transfer device 400 (corresponding to the rear side of the housing) opposite to the cartridge holder 61 and the liquid feed pump unit 63. An encoder unit 171 for detecting the amount of rotation of the first drive motor 101 is attached to the gear 104A of the first drive motor 101.

As shown in FIG. 16, the driving force from the drive gear 113 of the drive transfer device 400 is transmitted to the suction pump 46 of the maintenance recovery device 41 via a driving force transmission device 700. As shown in FIG. 17, the driving force from the drive gear 114 connected to the drive transfer device 400 is transmitted to the air-vent opening pin 302 via a driving force transmission device 310 so as to make the air vent device 207 of the head tank 12 open to the atmosphere. The driving force transmission device 310 is arranged to bypass the bottom of the maintenance recovery device 41.

As shown in FIGS. 16 to 19, the drive transfer device 400 is arranged in a position where it is surrounded by the liquid feed pump unit 63, the maintenance recovery device 41 and the carriage 4. The arrangement of the drive transfer device 400 is an optimum arrangement for ensuring downsizing of the image forming device.

The drive transfer device 400 and the suction pump 46 of the maintenance recovery device 41 are arranged on opposite sides of the cap 42 of the maintenance recovery device 41 in the sheet transport direction. In the present embodiment, the drive transfer device 400 and the suction pump 46 are arranged on the rear side of the housing 1000.

In order to perform maintenance and recovery of the recording head 11, the cap 42 of the maintenance recovery device 41 has to be arranged immediately below the recording head 11. Moreover, in order to allow attachment and detachment of the ink cartridge 62 on the front side of the housing 1000, the cartridge holder 61 (to which the ink cartridge 62 is attached) has to be arranged on the front side of the housing 1000.

As described above, arranging the drive transfer device 400 in a position where the drive transfer device 400 is surrounded by the liquid feed pump unit 63, the maintenance recovery device 41 and the carriage 4 in the image forming device is optimum for ensuring downsizing of the image forming device. However, it is difficult to secure a space for arranging the suction pump 46 of the maintenance recovery device 41 in such a position between the liquid feed pump unit 63 and the cap 42 of the maintenance recovery device 41.

To eliminate the problem, in the image forming device of the present embodiment, the drive transfer device 400 and the suction pump 96 of the maintenance recovery device 41 are arranged on the opposite sides of the cap 42 and the driving force is transmitted to the suction pump 96 via the driving force transmission device 700. The downsizing of the image forming device can be ensured and the cost can be reduced.

Moreover, the carriage 4, the drain liquid tank 71, the guide member 3, etc., are densely arranged in the circumferential portions of the drive transfer device 400, the liquid feed pump unit 63 and the maintenance recovery device 41 in the image forming device of the present embodiment, and there is no adequate space for arranging the air-vent opening parts to open the air vent device 207 of the head tank 12. To eliminate the problem, the driving force transmission device 310 which is formed from link members and arranged to bypass the maintenance recovery device 41 is used to operate the air vent device 207.

In the image forming device of the present embodiment, the air-vent opening pins 302 are arranged to have the maximum driving-force transmission path leading to the drive transfer device 400 among the liquid feed pump unit 63, the suction pump 46 of the maintenance recovery device 41 and the air-vent opening pins 302, to which the driving force of the first drive motor 101 is transmitted by the drive transfer device 400. Thereby, saving of the internal space of the image forming device can be ensured.

Next, the transmission of the driving force from the drive transfer device 400 to the suction pump 46 of the maintenance recovery device 41 will be described with reference to FIGS. 20 to 23.

Figure 20:
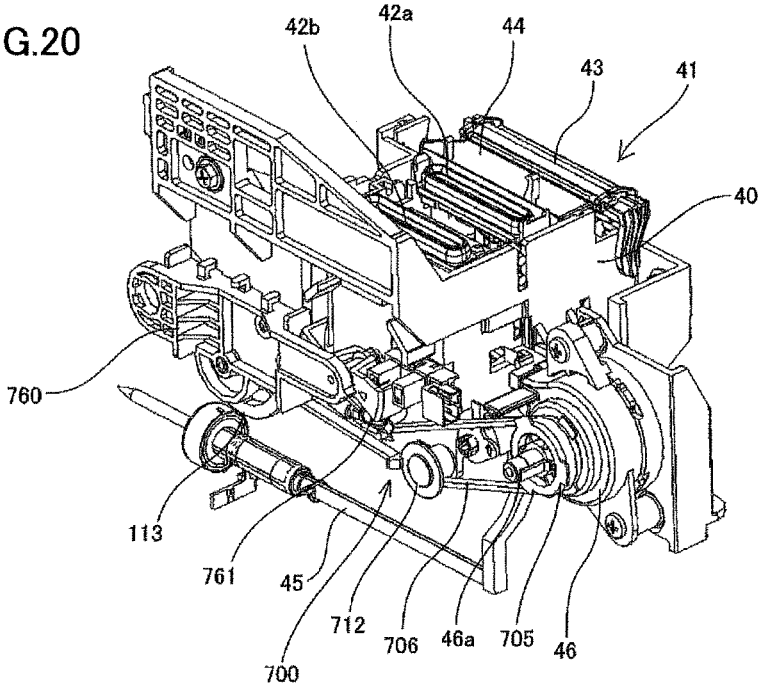
FIG. 20 is a perspective view of the maintenance recovery device.
Figure 21:
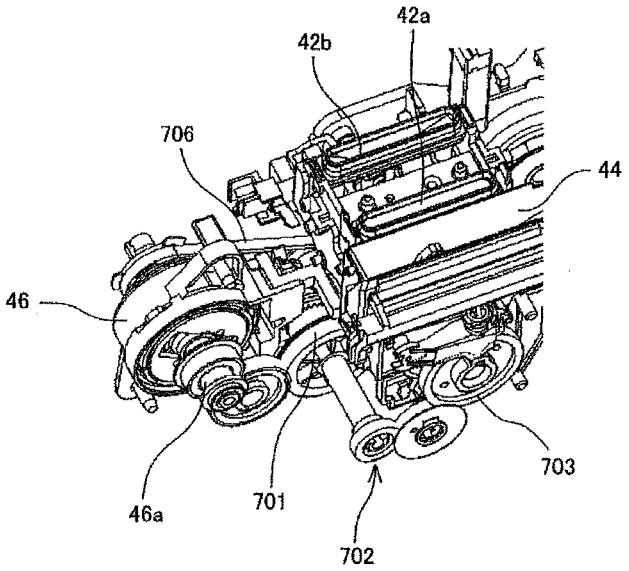
FIG. 21 is a perspective view of a main portion of the maintenance recovery device of FIG. 20 when viewed from the rear side thereof.
Figure 22:
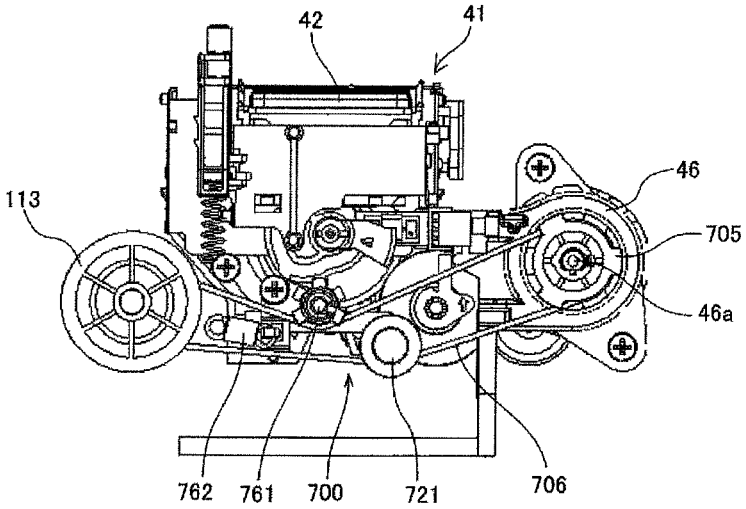
FIG. 22 is a side view of the maintenance recovery device of FIG. 20.
Figure 23:
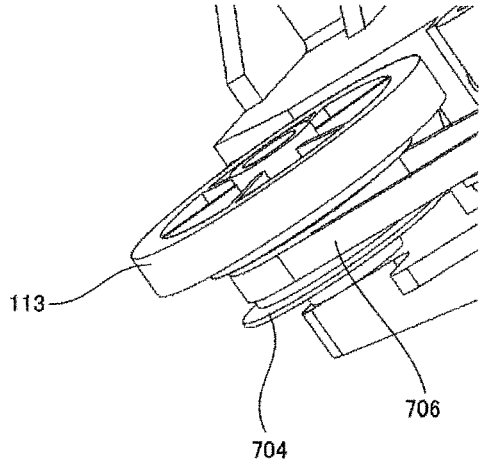
FIG. 23 is a perspective view of a portion of the maintenance recovery device of FIG. 20 in the vicinity of a suction pump.

FIG. 20 is a perspective view of the maintenance recovery device 41. FIG. 21 is a perspective view of a main portion of the maintenance recovery device of FIG. 20 when viewed from the rear side thereof. FIG. 22 is a side view of the maintenance recovery device of FIG. 20. FIG. 23 is a perspective view of a portion of the maintenance recovery device of FIG. 20 in the vicinity of the suction pump.

As shown in FIG. 20, the maintenance recovery device 41 includes the cap 42, the wiper member 43 and the dummy discharge receptacle 44 which are arranged in a frame 40. The movement of the cap 42 and the wiper member 43 relative to the recording head 11 (in this example, the up/down movement) is driven through the driving force transmission device 700 and the suction pump 46 by the drive transfer device 400.

As shown in FIG. 21, the driving force from the pump shaft 46*a* of the suction pump 46 is transmitted to a cap/wiper drive gear 703 via a one-way device 701 and a gear train 702. The one-way device 701 transmits the rotation of the pump shaft 46*a* of the suction pump 46 to the cap/wiper drive gear 703 only when the suction pump 46 is rotated forward or the suction pump 46 is in an idle condition. The one-way device 701 does not transmit the rotation of the pump shaft 46*a* of the suction pump 46 to the cap/wiper drive gear 703 when the suction pump 46 is rotated backward or the suction pump 46 performs the suction operation.

When the cap/wiper drive gear 703 is rotated, the cap 42 and the wiper member 43 are moved through a cam (which is not illustrated) by the cap/wiper drive gear 703.

As shown in FIGS. 22 and 23, the driving force transmission device 700 includes the drive gear 113 to which the driving force from the change gear 106D of the drive transfer device 400 is transmitted, and a timing belt 706 which is wound between a pulley 704 integrally formed with the drive gear 113 and a pulley 705 formed on the pump shaft 46*a* of the suction pump 46 via a tightener 761 and a middle pulley 721.

In the present embodiment, the driving force is transmitted from the drive transfer device 400 to the suction pump 46 through the timing belt 706. When compared with a case in which the driving force is transmitted between the drive transfer device 400 and the suction pump 46 which are arranged on both sides of the cap 42 by a gear train, the power loss in the present embodiment can be reduced.

Next, a positioning structure for the change gear 106D of the drive transfer device 400 and the drive gear 113 of the driving force transmission device 700 will be described with reference to FIGS. 24 to 27.

Figure 24:
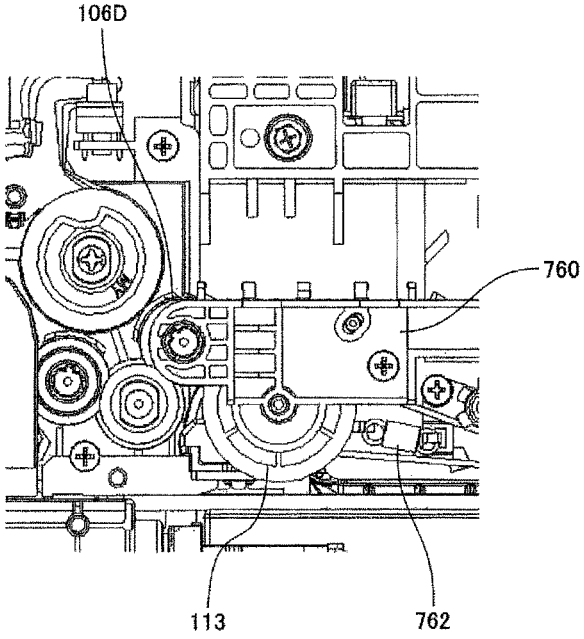
FIG. 24 is a side view of a main portion of the maintenance recovery device.
Figure 25:
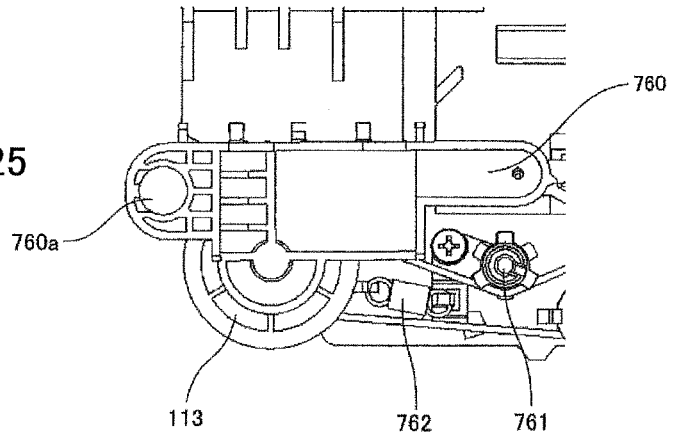
FIG. 25 is a side view of a portion of the maintenance recovery device in the vicinity of a gear pitch regulation member.
Figure 26:
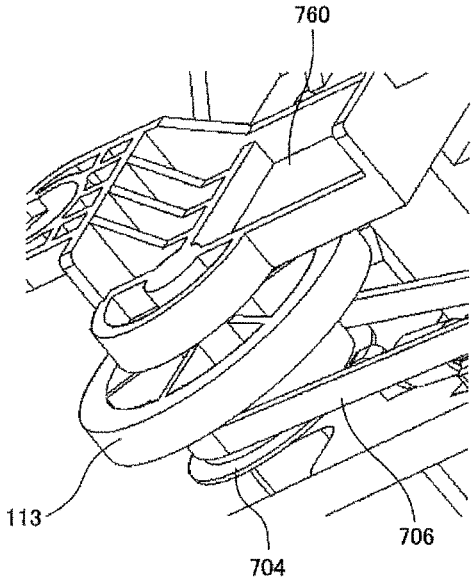
FIG. 26 is a perspective view of the portion of the maintenance recovery device.
Figure 27:
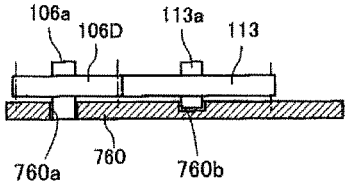
FIG. 27 is a plan view of the portion of the maintenance recovery device.

FIG. 24 is a side view of a main portion of the maintenance recovery device 41. FIG. 25 is a side view of a portion of the maintenance recovery device 41 in the vicinity of a gear pitch regulation member 760. FIG. 26 is a perspective view of the portion of the maintenance recovery device 41. FIG. 27 is a plan view of the portion of the maintenance recovery device 41.

The maintenance recovery device 41 and the drive transfer device 400 are formed into sub-units, respectively, and there may be a case in which the dimensions of a pitch between are inaccurate due to variations of component tolerances between the change gear 106D of the drive transfer device 400 and the drive gear 113 of the driving force transmission device 700.

To eliminate the problem, in this embodiment, the gear pitch regulation member 760 is provided to regulate a pitch between the change gear 106D and the drive gear 113. For example, as shown in FIG. 27, the gear pitch regulation member 760 includes a hole portion 760*a* to support a shaft 106*a* of the change gear 106D and a recess portion 760*b* to support a shaft 113*a* of the drive gear 113.

The gear pitch regulation member 760 is attached to a frame 40 of the maintenance recovery device 41 such that the gear pitch regulation member 760 is loosely movable relative to the frame 40. When the maintenance recovery device 41 is mounted on the side plate 1*b* and positioned to the drive transfer device 400, the loose fitting of the gear pitch regulation member 760 relative to the frame 40 is disabled and the gear pitch regulation member 760 is fixed to the frame 40.

The tension of the timing belt 706 is adjusted to a certain tension level when the tightener 761 is pushed by a spring 762. This enables the tightness or looseness of the timing belt 706 caused by the movement of the gear pitch regulation member 760 to be corrected.

Next, the detailed structure of the driving force transmission device 310 will be described with reference to FIGS. 28 and 29.

Figure 28:
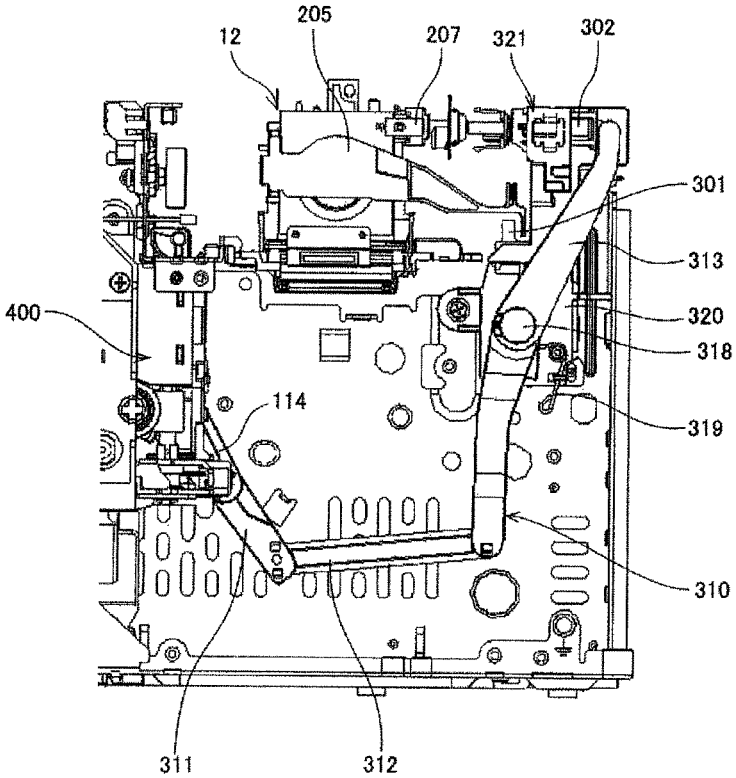
FIG. 28 is a side view of a driving force transmission device.

FIG. 28 is a side view of a main portion of the driving force transmission device 310. FIG. 29 is a diagram for explaining the driving force transmission device 310 of FIG. 28.

Figure 29:
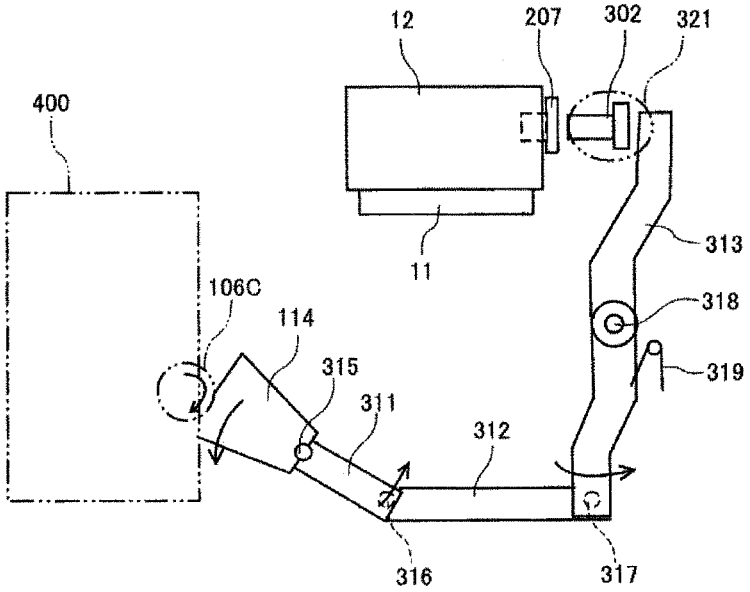
FIG. 29 is a diagram for explaining the driving force transmission device of FIG. 28.

As shown in FIGS. 28 and 29, the driving force transmission device 310 is a link mechanism which includes a link member 311, one end of which is integrally formed with the drive gear 114 engaged with the change gear 106C, a middle link member 312, and an air-vent opening lever 313 adapted for pushing the air-vent opening pin 302.

The link member 311 is pivotably supported at the end thereof by a shaft member 315 so that the link member 311 is able to swing around the shaft member 315. The air-vent opening lever 313 is pivotably supported at its middle portion by a shaft member 318 so that the air-vent opening lever 313 is able to swing around the shaft member 318. The air-vent opening lever 313 is pulled in a direction separated from the air-vent opening pin 302 by a spring 319. The link members 311 and 312 are connected together by a shaft member 316 so that the link member 312 is able to swing relative to the link member 311 around the shaft member 316. The link member 312 and the air-vent opening lever 313 are connected together by a shaft member 137 so that the air-vent opening lever 313 is able to swing relative to the link member 312 around the shaft member 137.

The air-vent opening lever 313 is arranged so that the leading end of the air-vent opening lever 313 faces the rear surface of the air-vent opening pin 302. The air-vent opening pin 302 is held on a bracket 320 via a latch part 321. The latch part 321 is a device which advances or retreats the air-vent opening pin 302 whenever the air-vent opening pin 302 is pushed or released by the air-vent opening lever 313. Alternatively, the latch part 321 may be disposed in the air vent device 207 of the head tank 12 on the side of the carriage 4.

For example, when the change gear 106C of the drive transfer device 400 is rotated in a direction indicated by the arrow in FIG. 29, the link member 311 connected to the drive gear 114 swings in a direction indicated by the arrow in FIG. 29. The movement of the link member 311 is transferred via the link member 312 to the air-vent opening lever 313, and the air-vent opening lever 313 swings in a direction indicated by the arrow in FIG. 29. Hence, the air-vent opening pin 302 is pushed by the air-vent opening lever 313 and the air vent device 207 of the head tank 12 is opened to the atmosphere (the air vent device 207 is in the open state).

In the present embodiment, during the maintenance and recovery process, it is necessary to operate the liquid feed pump 631 and the maintenance recovery device 41 while the air vent device 207 of the head tank 12 is opened to the atmosphere. When the first drive motor 101 is rotated in the reverse rotation direction, the air-vent opening lever 313 returns back to the original state as shown in FIG. 29. However, the air-vent opening pin 302 is held in the active state by the latch part 302 and the air vent device 207 of the head tank 12 is maintained in the open state.

Subsequently, the air-vent opening lever 313 is driven again to swing in the direction indicated by the arrow in FIG. 29 and push the air-vent opening pin 302, so that the air vent device 207 of the head tank 12 is closed.

Next, the arrangement of the drive transfer device, the liquid feed pump, the maintenance recovery device and the driving force transmission device in the image forming device of the embodiment will be described with reference to FIGS. 30 and 31.

Figure 30:
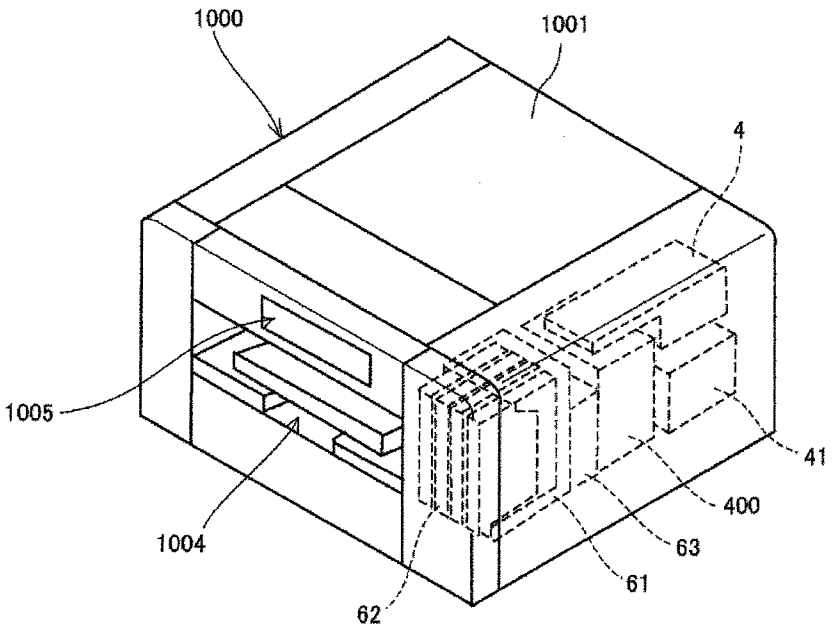
FIG. 30 is a perspective view showing the arrangement of the drive transfer device, the liquid feed pump unit and the maintenance recovery device.

FIG. 30 is a perspective view showing the arrangement of the drive transfer device 400, the liquid feed pump unit 63 and the maintenance recovery device 41. FIG. 31 is a diagram for explaining the arrangement of the drive transfer device 400, the liquid feed pump unit 63, the maintenance recovery device 41 and the driving force transmission device 310.

As shown in FIG. 30, a sheet supply/ejection tray 1004 is detachably attached to a front-side portion of the housing 1000 and the sheet supply/ejection tray 1004 includes a sheet supply tray for containing recording sheets and a sheet ejection tray for stacking image-formed recording sheets, wherein the sheet supply tray and the sheet ejection tray are united together. Moreover, an operation panel 1005 is provided on an upper front surface of the housing 1000 and the operation panel 1005 includes operation buttons, indicators, etc.

Figure 31:
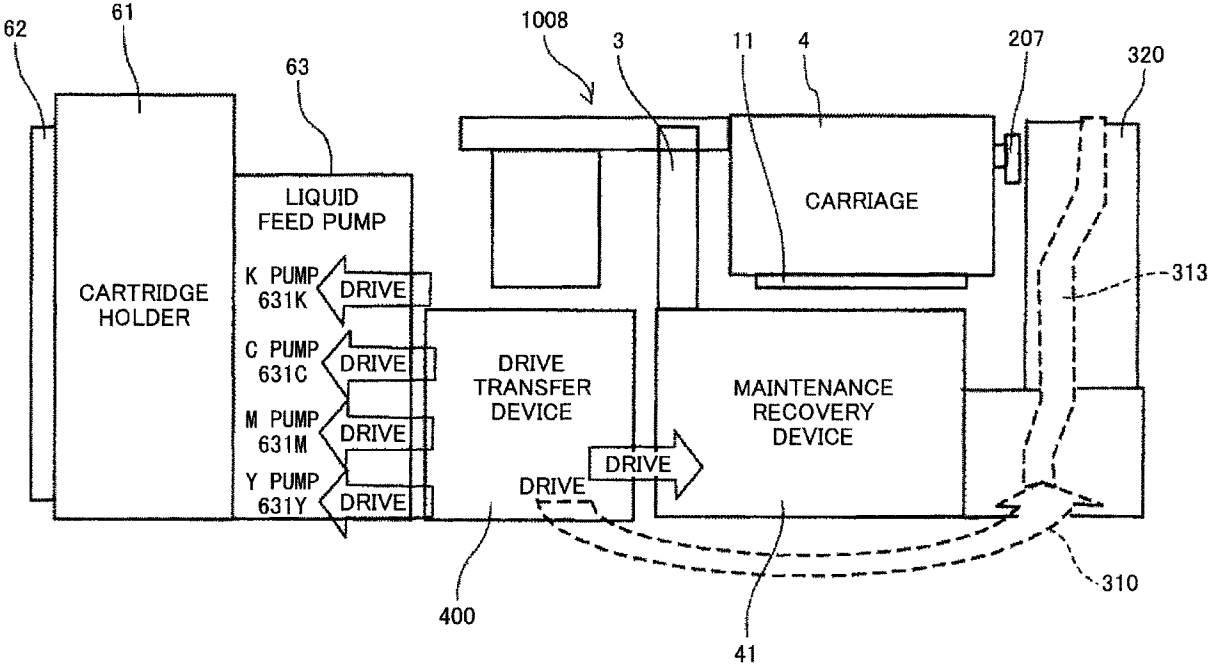
FIG. 31 is a diagram for explaining the arrangement of the drive transfer device, the liquid feed pump unit, the maintenance recovery device and a driving force transmission device.

As shown in FIGS. 30 and 31, in the image forming device of the present embodiment, the maintenance recovery device 41, the drive transfer device 400, the liquid feed pump unit 63 and the cartridge holder 61 are arranged in this order in the sheet transport direction (from the upstream to the downstream in the sheet transport direction). Moreover, the carriage 4 and a carriage driving device 1008 are arranged in a position higher than the liquid feed pump unit 63 and the maintenance recovery device 41 in the height direction of the housing 1000.

The drive transfer device 400 is arranged between the liquid feed pump unit 63 and the maintenance recovery device 41 with respect to the sheet transport direction. The drive transfer device 400 is arranged in a position lower than the carriage driving device 1008 in the height direction of the housing 1000.

In the image forming device of the present embodiment, the suction pump 46 of the maintenance recovery device 41 and the drive transfer device 400 are arranged on the opposite sides of the cap 42, and the driving force from the drive transfer device 400 is transmitted to the suction pump 46 through the driving force transmission device 700 (FIG. 20).

Further, the driving force from the drive transfer device 400 is transmitted to the air-vent opening pin 302 (which allows the air vent device 207 of the head tank 12 to be opened to the atmosphere) through the driving force transmission device 310 (FIG. 28) which bypasses the bottom of the maintenance recovery device 41.

As described above, in the image forming device of the present embodiment, the carriage 4, the drain liquid tank 71, the guide member 3, etc., are densely arranged in the circumferential portions of the drive transfer device 400, the liquid feed pump unit 63 and the maintenance recovery device 41, and there is no adequate space for arranging the air-vent opening part to open the air vent device 207 of the head tank 12.

Therefore, the image forming device of the present embodiment is arranged so that the air-vent opening part (the air-vent opening pin 302) is arranged to have the maximum driving-force transmission path leading to the drive transfer device 400, and the driving force transmission device 310, which is formed from the link members and arranged to bypass the maintenance recovery device 41, is used to drive the air-vent opening pin 302 to open the air vent devices 207 of the head tank 12.

Thus, in the image forming device of the present embodiment, the air-vent opening pins 302 are arranged to have the maximum driving-force transmission path leading to the drive transfer device 400 among the liquid feed pumps 631, the suction pump 46 of the maintenance recovery device 41 and the air-vent opening pins 302, to which the driving force of the first drive motor 101 is transmitted by the drive transfer device 400. In the image forming device of the present embodiment, the maintenance recovery device 41, the drive transfer device 400 and the liquid feed pumps 631 are arranged in this order in the sheet transport direction. Further, in the image forming device of the present embodiment, the suction pump 46 of the maintenance recovery device 41 and the drive transfer device 400 are arranged on the opposite sides of the cap of the maintenance recovery device in the sheet transport direction. Therefore, downsizing of the image forming device can be ensured.

In the foregoing description, the term "recording sheet" is not limited to paper and may also refer to a medium to which ink drops or other liquid drops can adhere, including an OHP sheet, fabric, glass, a substrate, etc. These are also called a medium to be recorded on, a recording medium, recording paper, a print medium, a printing sheet, etc. The term "image forming" may also refer to recording, printing text, imaging, and printing.

Moreover, in the foregoing description, the term "image forming device" may refer to a device to form images by discharging liquid to a medium such as paper, yarn, a fiber, fabric, leather, metal, plastic, glass, wood, and ceramics. The expression "forming images" is not limited to providing a medium with an image with a meaning such as text and figures, and may also refer to providing a medium with an image without a meaning such as a pattern (liquid drops are simply discharged to a medium). The term "ink" is not limited to regularly known inks and may also refer to all liquid that can be used for forming images, including a DNA sample, resist, pattern material, resin, etc. Further, the term "image" is not limited to a two-dimensional image and may also refer to an image assigned to a three-dimensional object and a three-dimensionally developed image.

Moreover, unless otherwise specified, the Image forming device according to the invention may include both a serial image forming device and a line image forming device.

The image forming device according to the invention is not limited to the specifically disclosed embodiments, and variations and modifications may be made without departing from the scope of the invention.

The present application is based upon and claims the benefit of priority of Japanese Patent Application No. 2012-222425, filed on Oct. 4, 2012, the contents of which are incorporated herein by reference in their entirety.

What is claimed is:

1. An image forming device, comprising:

a recording head adapted to discharge liquid drops of different kinds;

a plurality of head tanks that supply liquids of the different kinds to the recording head;

a plurality of main tanks that accommodate the liquids to be supplied to the recording head;

a plurality of liquid feed pumps that supply the liquids from the plurality of main tanks to the plurality of head tanks and send back the liquids from the plurality head tanks to the plurality of main tanks;

a maintenance recovery device that maintains and recovers states of nozzle faces of the recording head, the maintenance recovery device including a cap operable to perform capping of the nozzle faces of the recording head and a suction part connected to the cap;

an air-vent opening part that is operable to open and close an air vent device disposed in each of the plurality of head tanks so as to make an internal space of each of the plurality of head tanks open and closed to an external atmosphere;

a first drive source; and a drive transfer device that selectively transmits a driving force of the first drive source to one of the plurality of liquid feed pumps, the suction part of the maintenance recovery device and the air-vent opening part, wherein the air-vent opening part is arranged to have a maximum driving-force transmission path leading to the drive transfer device among the plurality of liquid feed pumps, the suction part and the air-vent opening part, to which the driving force of the first drive source is transmitted by the drive transfer device, wherein the maintenance recovery device, the drive transfer device and the plurality of liquid feed pumps are arranged in order in a sheet transport direction, and wherein the suction part of the maintenance recovery device and the drive transfer device are arranged on opposite sides of the cap of the maintenance recovery device in the sheet transport direction.

2. The image forming device according to claim 1, wherein the drive transfer device comprises:

a second drive source;

a cam that is rotated by the second drive source;

a slider member that is interlocked with the rotation of the earn and moved in a thrust direction; and a change gear that is rotatably supported on the slider member and shifted, when a driving force of the second drive source is transmitted to move the slide member, between a first position where the change gear is engaged with a drive gear of one of the plurality of liquid feed pumps or a drive gear of the suction part and a second position where the change gear is disengaged, wherein a drive gear of the first drive source is engaged with the change gear and the drive transfer device selectively transmits the driving force of the first drive source to one of the plurality of liquid feed pumps and the suction part according to the shifting of the change gear.

3. The image forming device according to claim 1, wherein a latch part is disposed in at least one of the air-vent opening part and the air vent device, the latch part maintaining an open state of the air vent device even after the drive transfer device is deactivated, until the air-vent opening part is operated to close the air vent device.

4. The image device according to claim 1, wherein a link mechanism is arranged in the driving-force transmission path extending from the air-vent opening part to the drive transfer device.

5. An image forming device, comprising:

a recording head adapted to discharge liquid drops of different kinds;

a plurality of head tanks that supply liquids of the different kinds to the recording head;

a plurality of main tanks that accommodate the liquids to be supplied to the recording head;

a plurality of liquid feed pumps that supply the liquids from the plurality of main tanks to the plurality of head tanks and send back the liquids from the plurality head tanks to the plurality of main tanks;

a maintenance recovery device that maintains and recovers states of nozzle faces of the recording head, the maintenance recovery device including a cap operable to perform capping of the nozzle faces of the recording head and a suction part connected to the cap;

an air-vent opening part that is operable to open and close an air vent device disposed in each of the plurality of head tanks so as to make an internal space of each of the plurality of head tanks open and closed to an external atmosphere;

a first drive source; and a drive transfer device that selectively transmits a driving force of the first drive source to one of the plurality of liquid feed pumps, the suction part of the maintenance recovery device and the air-vent opening part, wherein the air-vent opening part is arranged to have a maximum driving-force transmission path leading to the drive transfer device among the plurality of liquid feed pumps, the suction part and the air-vent opening part, to which the driving force of the first drive source is transmitted by the drive transfer device.

6. The image forming device according to claim 5, wherein the drive transfer device comprises:

a second drive source;

a cam that is rotated by the second drive source;

a slider member that is interlocked with the rotation of the earn and moved in a thrust direction; and a change gear that is rotatably supported on the slider member and shifted, when a driving force of the second drive source is transmitted to move the slide member, between a first position where the change gear is engaged with a drive gear of one of the plurality of liquid feed pumps or a drive gear of the suction part and a second position Where the change gear is disengaged, wherein a drive gear of the first drive source is engaged with the change gear and the drive transfer device selectively transmits the driving force of the first drive source to one of the plurality of liquid feed pumps and the suction part according to the shifting of the change gear.

7. The image forming device according to claim 5, wherein a link mechanism arranged in the driving-force transmission path extending from the air-vent opening part to the drive transfer device.

8. An image forming device, comprising:

a recording head adapted to discharge liquid drops of different kinds;

a plurality of head tanks that supply liquids of the different kinds to the recording head;

a plurality of main tanks that accommodate the liquids to be supplied to the recording head;

a plurality of liquid feed pumps that supply the liquids from the plurality of main tanks to the plurality of head tanks and send hack the liquids from the plurality head tanks to the plurality of main tanks;

a maintenance recovery device that maintains and recovers states of nozzle faces of the recording head, the maintenance recovery device including a cap operable to perform capping of the nozzle faces of the recording head and a suction part connected to the cap;

a first drive source; and a drive transfer device that selectively transmits a driving force of the first drive source to one of the plurality of liquid feed pumps and the suction part of the maintenance recovery device, wherein the maintenance recovery device, the drive transfer device and the plurality of liquid feed pumps are arranged in order in a sheet transport direction, and wherein the suction part of the maintenance recovery device and the drive transfer device are arranged on opposite sides of the cap of the maintenance recovery device in the sheet transport direction.

9. The image forming device according to claim 8, wherein the drive transfer device comprises:

a second drive source;

a cam that is rotated by the second drive source;

a slide member that is interlocked with the rotation of the a and moved in a thrust direction; and a change gear that is rotatably supported on the slider member and shifted, when a driving force of the second drive source is transmitted to move the slide member, between a first position where the change gear is engaged with a drive gear of one of the plurality of liquid feed pumps or a drive gear of the suction part and a second position where the change gear is disengaged, wherein a drive gear of the first drive source is engaged with the change gear and the drive transfer device selectively transmits the driving force of the first drive source to one of the plurality of liquid feed pumps and the suction part according to the shifting of the change gear.

10. The image forming device according to claim 9, further comprising a gear pitch regulation part that regulates a pitch between a final-stage change gear of the drive transfer device to transmit the driving force of the first drive source to the suction part and the drive gear of the suction part engaged with the final-stage change gear of the drive transfer device.

11. The image forming device according to claim 10, wherein the gear pitch regulation member is movably attached to a frame of the maintenance recovery device, and when the maintenance recovery device is positioned to the drive transfer device, loose fitting of the gear pitch regulation member to the frame of the maintenance recovery device is disabled and the gear pitch regulation member is fixed to the frame of the maintenance recovery device.

12. The image forming device according to claim 8, wherein:

each of the plurality of head tanks includes an air vent device that is operable to make an internal space of the head tank open to an external atmosphere;

an air-vent opening part is arranged in a housing of the image forming device to be operable to open and close the air vent device; and the drive transfer device includes a slider member and a change gear rotatably supported on the slider member, the change gear being shifted, when the slide member is moved, between a first position where the change gear is engaged with a drive gear of the air-vent opening part and a second position where the change gear is disengaged from the drive gear.

* * * * *